US008757615B2

(12) United States Patent
Komatsu et al.

(10) Patent No.: US 8,757,615 B2
(45) Date of Patent: Jun. 24, 2014

(54) BILL ACCUMULATION DEVICE

(75) Inventors: Hirokazu Komatsu, Gunma (JP); Shinji Sado, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/522,610

(22) PCT Filed: Dec. 9, 2010

(86) PCT No.: PCT/JP2010/072150

§ 371 (c)(1),
(2), (4) Date: Jul. 17, 2012

(87) PCT Pub. No.: WO2011/089793

PCT Pub. Date: Jul. 28, 2011

(65) Prior Publication Data

US 2012/0292849 A1 Nov. 22, 2012

(30) Foreign Application Priority Data

Jan. 21, 2010 (JP) ..... 2010-011452

(51) Int. Cl.
*B65H 31/36* (2006.01)

(52) U.S. Cl.
USPC ..... 271/224; 271/207

(58) Field of Classification Search
USPC ..... 271/3.02, 217, 220, 167, 169, 207; 220/623, 671, 673
See application file for complete search history.

(56) References Cited

U.S. PATENT DOCUMENTS

| | | | | |
|---|---|---|---|---|
| 5,451,041 | A * | 9/1995 | Greive | 271/98 |
| 6,494,450 | B2 * | 12/2002 | Tsurumaki | 271/224 |
| 7,152,859 | B2 * | 12/2006 | Flynn et al. | 271/121 |
| 7,530,567 | B2 * | 5/2009 | Bober et al. | 271/220 |
| 7,588,249 | B2 * | 9/2009 | Caron et al. | 271/221 |
| 7,837,190 | B2 * | 11/2010 | Feygelman et al. | 271/220 |
| 7,852,526 | B2 * | 12/2010 | Mo et al. | 358/498 |
| 8,256,761 | B1 * | 9/2012 | Klein | 271/121 |
| 2007/0253037 | A1 * | 11/2007 | Mo et al. | 358/498 |

FOREIGN PATENT DOCUMENTS

| | | | | |
|---|---|---|---|---|
| JP | 01156276 | A * | 6/1989 | B65H 31/26 |
| JP | 05310359 | A * | 11/1993 | B65H 31/34 |
| JP | 07-061683 | A | 3/1995 | |
| JP | 09-208108 | A | 8/1997 | |
| JP | 2009-073641 | A | 4/2009 | |

* cited by examiner

*Primary Examiner* — Jeremy R Severson
(74) *Attorney, Agent, or Firm* — Rabin & Berdo, P.C.

(57) ABSTRACT

Disclosed is a compact bill accumulation device which has a bill accumulation space with decreased depth and does not cause bill accumulation errors. The bill accumulation device (100) is provided with front guides (8) and reverse guides which form a bill accumulation space, and with a bill stopper (6) which, disposed on the front guides (8), stops bills released by a by a feed roller (1), wherein bills stopped by said bill stopper (6) are accumulated on a stage (4). Multiple V-shaped grooves are formed on elongate ribs (18) and disposed along the long direction of the ribs, said grooves extending in the short direction thereof; said ribs (18) are arranged in rows and at prescribed intervals on either side of the front guides (8) so as to be perpendicular to said released bills.

18 Claims, 10 Drawing Sheets

BILL ACCUMULATION DEVICE

TECHNICAL FIELD

The present invention relates to a bill accumulation device for stacking, in a stacking unit, bills such as banknotes and various coupons of value that have been introduced (inserted) into an apparatus such as an automated teller machine.

BACKGROUND ART

Explanation follows regarding a related bill accumulation device, with reference to FIG. 11, a front view illustrating relevant portions of a configuration of a bill accumulation device in a related example, FIG. 12, a side view illustrating relevant portions of a configuration of a bill accumulation device in a related example, and FIG. 13 a plan view of relevant portions of a configuration of a bill accumulation device in a related example.

A bill accumulation device 200 in FIG. 11, FIG. 12 and FIG. 13 is generally configured with disposed components including a feed roller 101, a reverse roller 102, a picker roller 103, a stage 104, an impeller 105, bill stoppers 106, a reverse guide 107, front guides 108, a picker arm 109, a drive belt 110, a picker shaft 111, a run sensor 112, a top face sensor 113, a conveying path 115 and an external wall 117. The authentication section 116 is disposed on a conveying path 115 (the port for taking in and discharging banknotes using the feed roller 101 and the reverse roller 102 is referred to below as the "gate").

The feed roller 101 and the reverse roller 102 are disposed with a slight overlap between their respective peripheral faces, and together function as a banknote intake port when banknotes are being separated and function as a banknote discharge port when banknotes are being stacked.

The feed roller 101 is rotatable by a drive transmission system, not shown in the drawings, in both the clockwise direction and the anti-clockwise direction as viewed in FIG. 11, and in order to ensure that two or more banknotes are not fed out at the same time during banknote separation the reverse roller 102 is only rotatable by a drive transmission system, not shown in the drawings, in the clockwise direction as viewed in FIG. 11.

The picker roller 103 is disposed so as to face the stage 104 on the banknote accumulation space side when viewed from the gate, and is supported by the picker arm 109 and the picker shaft 111 so as to move up or down about the feed roller 101, and a high friction member is attached to a portion of the peripheral face of the picker roller 103. Configuration is made such that drive from the feed roller 101 is transmitted by a drive belt 110 to the picker roller 103 so as to rotate the picker roller 103 in synchronization with the feed roller 101.

The stage 104 is configured capable of moving up or down by a drive transmission system, not shown in the drawings, so as to nip banknotes 114 between the stage 104 and the picker roller 103 when separation is being performed to generate an appropriate amount of feeding force, and during stacking, under constant monitoring by the top face sensor 113, so as to change position so as to secure a constant accumulation space.

The impellers 105 are of a construction including radial shaped projection portions formed from a high friction member of a resilient material, as shown in FIG. 11, with plural of the impellers 105 disposed in a row at the sides of the reverse roller 102. During stacking, the impellers 105 are rotated in a clockwise direction as viewed in FIG. 11 by a power transmission system, not shown in the drawings, with the rotation axis of the impellers 105 positioned substantially coaxially to the rotation axis of the reverse roller 102, and during separation, the impellers 105 are retracted by a retraction mechanism, not shown in the drawings, such that the projection portions of the impellers 105 are in a position that does not overlap with either the gate section or the stacking area.

Plural bill stoppers 106 are disposed in a row on the front guide 8 at positions facing the gate, disposed such that the leading edges of the banknotes 114 discharged during stacking impact the bill stoppers 106. Springs, not shown in the drawings, are connected to the bill stoppers 106, such that kinetic energy of discharged banknotes during stacking can be absorbed when the leading edge of the discharged banknotes 114 impact the bill stoppers 106.

The bill stoppers 106 have V-shaped grooves in the face impacted by the banknotes 114, as shown in FIG. 14A, thereby preventing the end faces of the impacted banknotes 114 from sliding up or down and preventing the banknotes 114 from being curled over.

The reverse guide 107 is disposed so as to cover the reverse roller 102, such that the reverse roller 102 projects out through a hole therein, not shown in the drawings.

The front guide 108 is disposed so as to face the reverse guide 107 at both sides in the banknote length direction, configuring a stacking space, and forming a banknote accumulation space that is slightly larger than the banknote 114 in the banknote length direction.

The front guide 108 is attached to the external wall 117 configuring the outer shape of the separation and stacking section. The banknotes 114 carried in from the conveying path 115 pass across the run sensor 112 and are discharged from the gate port into the banknote accumulation space. Conveying of a banknote 114 is ascertained by the banknote 114 passing across the run sensor 112.

Stacking of the banknotes 114 is accomplished by the banknote 114 that has passed through the conveying path 115 then passing through between the feed roller 101 that is rotating in the anticlockwise direction as viewed in FIG. 11 and the reverse roller 102 that is rotating in the clockwise direction, and the leading edge of the banknote then hits the bill stoppers 106 and the rear edge of the banknote is tapped down by the clockwise rotating impellers 105, so as to be stacked on the stage 104.

Due to being placed on the conveying path 115, the authentication section 116 collects running data such as denomination discrimination, authenticity discrimination, and angle of the banknote (skew) for each of the banknotes 114 travelling through the conveying path 115, and performs other checks, such as determining the running state of the banknote.

Separating the banknotes 114 is performed by pressing the banknotes 114 stacked on the stage 104 against the picker roller 103 by raising the stage 104, and feeding the banknote 114 that has been pressed against the picker roller 103 out into the conveying path 115 with the picker roller 103 and the feed roller 101 rotating in the clockwise direction as viewed in FIG. 11.

The banknotes 114 are moved while sliding against the bill stoppers 106 when the banknotes 114 stacked on the stage 104 are being pressed against the picker roller 103. The banknotes 114 are able to move without getting stuck in the grooves of the bill stoppers 106 due to the bill stoppers 106 being hidden in the face of the front guide 108 by compression of springs, not shown in the drawings, that press against the bill stoppers 106, as shown in FIG. 14B.

Such a bill accumulation device is configured capable of stacking banknotes with the banknote end faces making contact with the bill stoppers 106 without the corners of the banknotes hitting the external wall 17, even when banknotes for stacking are skewed (angled), due to sufficient separation distance being provided between the front guide 108 and the external wall 117, as shown in FIG. 15.

In such bill accumulation devices, in order to prevent banknote stacking problems there are also devices in which plural projection portions are provided to the banknote impact faces of both the left and right bill stoppers (see for example Japanese Patent Application Laid-Open (JP-A) No. 2009-73641 (paragraph [0014] to paragraph [0016], FIG. 1 and FIG. 2)).

DISCLOSURE OF INVENTION

Technical Problem

However, in the technology described above, if the banknotes for stacking are conveyed at an angle, when the end face of the angled banknote makes contact with the bill stoppers, the depth of the stacking space along the banknote conveying direction (the banknote short length) needs to be made longer in order to secure sufficient space as relief for the leading end portion of the banknotes, with an issue arising that the device also increases in size.

When the depth of the banknote accumulation space is shortened, as shown in FIG. 16 and FIG. 17, sometimes the corner of a skewed banknote impacts the external wall and the end portion of the banknote curls and rides up the front guide, subsequent banknotes then hit the previous curled banknote, and stacking problems occur since they are unable to make contact with the bill stoppers.

The present invention is directed to solving such problems, shortening the depth of the banknote accumulation space without banknote stacking problems arising, and thereby enabling a device to be made more compact.

Solution to Problem

Accordingly, a bill accumulation device of the present invention is a bill accumulation device including a front guide and a reverse guide, configuring an accumulation space for bills, and a bill stopper provided to the front guide for receiving and stopping bills discharged by conveying means, wherein: the bill accumulation device stacks the bills that have been received and stopped by the bill stopper on a stage; and plural elongated shaped ribs formed along the rib length direction with plural V-shaped grooves that extend along the rib short length direction are respectively disposed orthogonal to bills being discharged in a row at specific intervals from each other on both sides of the front guide.

Advantageous Effects of Invention

According to the thus configured present invention, the depth of the banknote accumulation space can be shortened without banknote stacking problems arising, thereby enabling a device to be made more compact.

BEST MODE FOR CARRYING OUT THE INVENTION

Explanation follows regarding an exemplary embodiment of a bill accumulation device according to the present invention, with reference to the drawings.

Exemplary Embodiment

Figure 1:
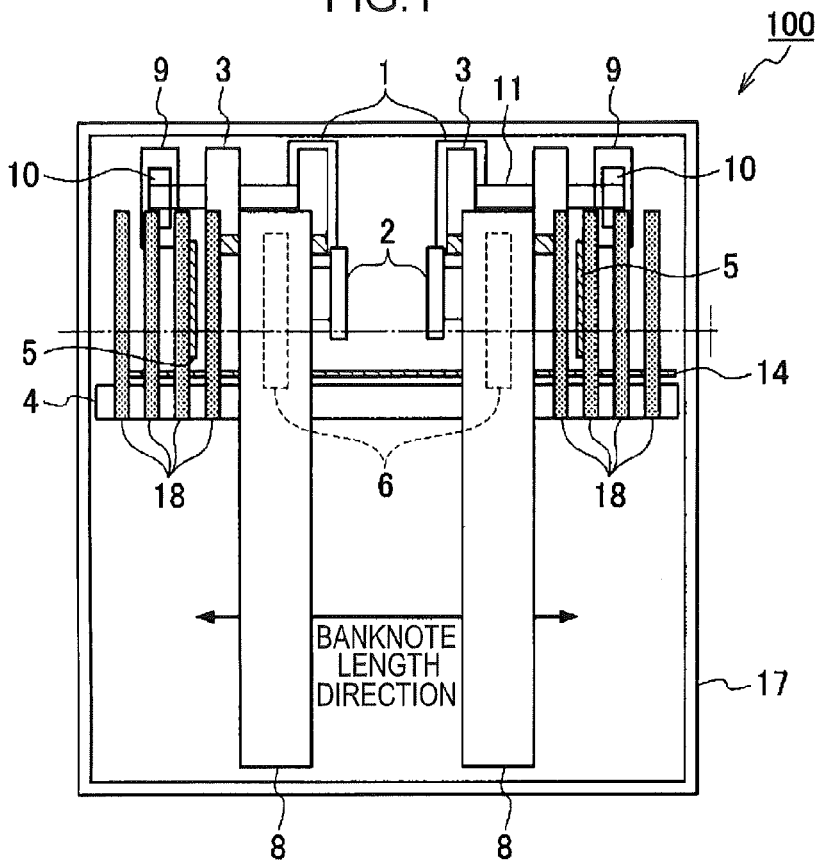
FIG. 1 is a side view illustrating relevant portions in a configuration of a bill accumulation device of an exemplary embodiment.
Figure 2:
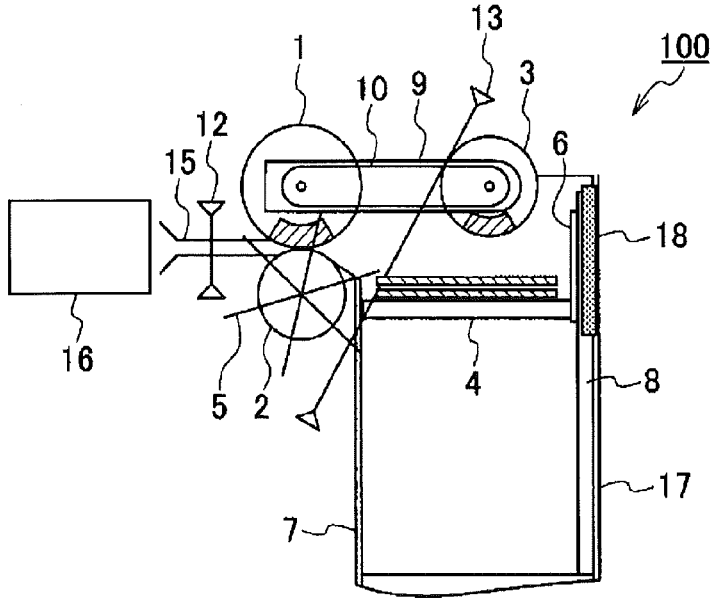
FIG. 2 is a front view illustrating relevant portions of a configuration of a bill accumulation device according to an exemplary embodiment.
Figure 3:
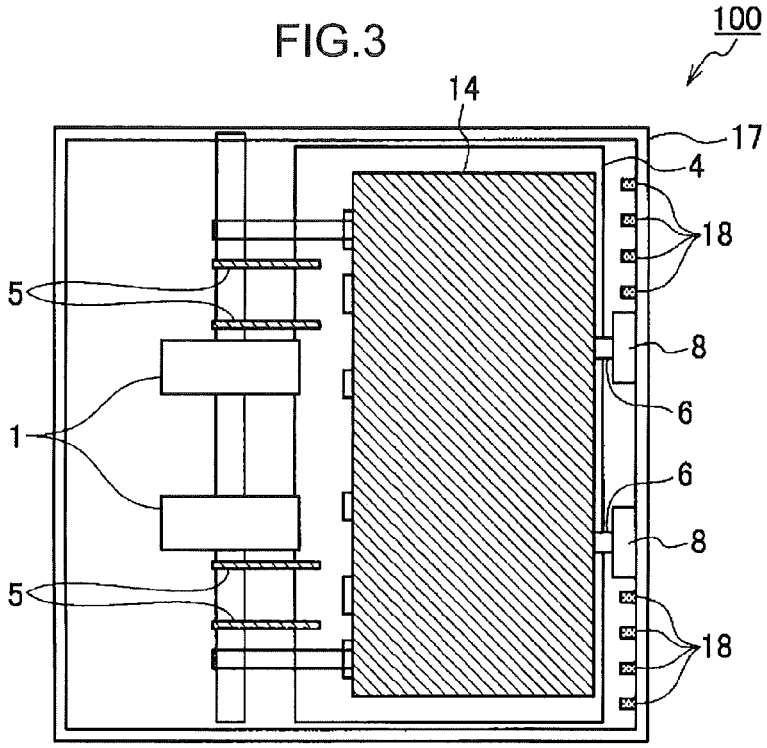
FIG. 3 is a plan view illustrating relevant portions of a configuration of a bill accumulation device according to an exemplary embodiment.

FIG. 1 is a side view illustrating relevant portions in a configuration of a bill accumulation device of an exemplary embodiment, FIG. 2 is a front view illustrating relevant portions of a configuration of a bill accumulation device according to an exemplary embodiment, and FIG. 3 is a plan view illustrating relevant portions of a configuration of a bill accumulation device according to an exemplary embodiment.

In FIG. 1, FIG. 2 and FIG. 3, a bill accumulation device 100 device is for stacking, in a stacking unit, bills of various types, such as banknotes and ledger sheets, train tickets and plane tickets (explanation is given in the present exemplary embodiment of banknotes as the bills), and similar to a related bill accumulation device, the bill accumulation device 100 is configured disposed with components including: a feed roller 1 serving as conveying means for conveying a banknote, a reverse roller 2, a picker roller 3, a stage 4 for stacking and accumulating banknotes on, an impeller 5, a bill stopper 6 that receives and stops discharged banknotes, a reverse guide 7 and front guides 8 that configure a banknote accumulation space, a picker arm 9, a moving belt 10, a picker shaft 11, a run sensor 12, a top face sensor 13, a conveying path 15 and an external wall 17.

Figure 11:
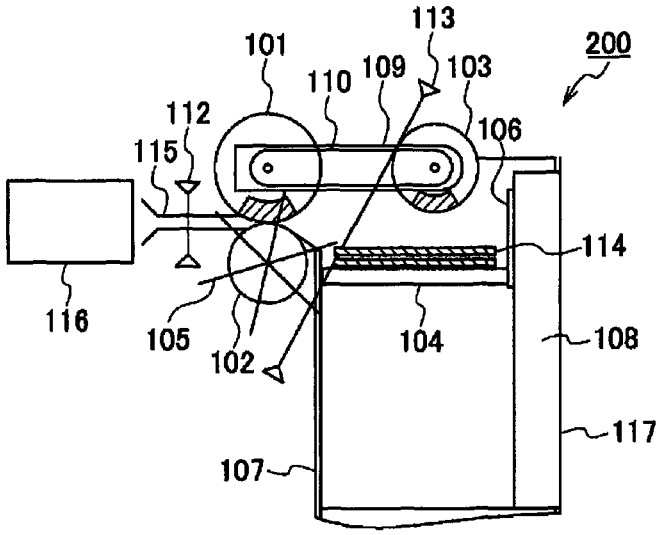
FIG. 11 is a front view illustrating relevant portions in a configuration of a bill accumulation device of a related example.
Figure 12:
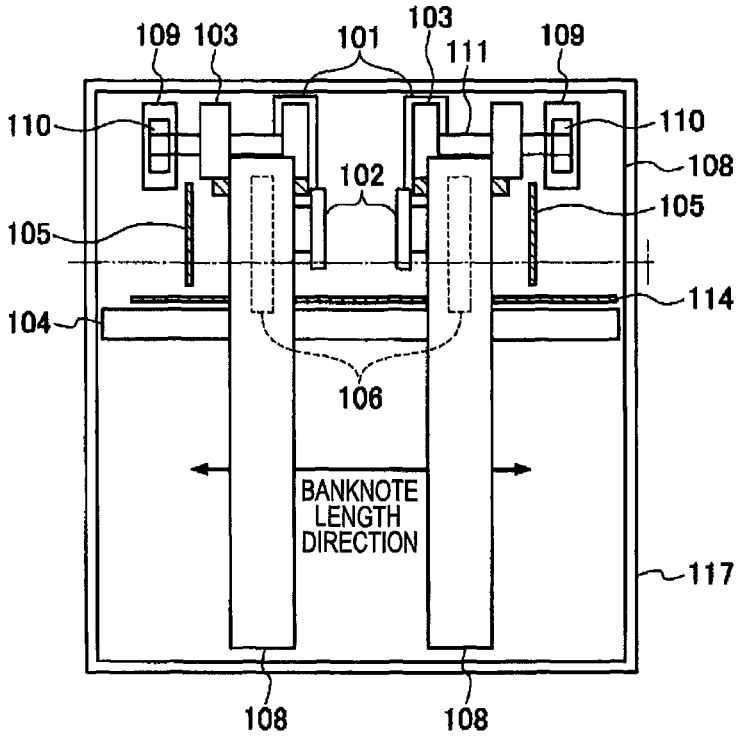
FIG. 12 is a side view illustrating relevant portions in a configuration of a bill accumulation device of a related example.
Figure 13:
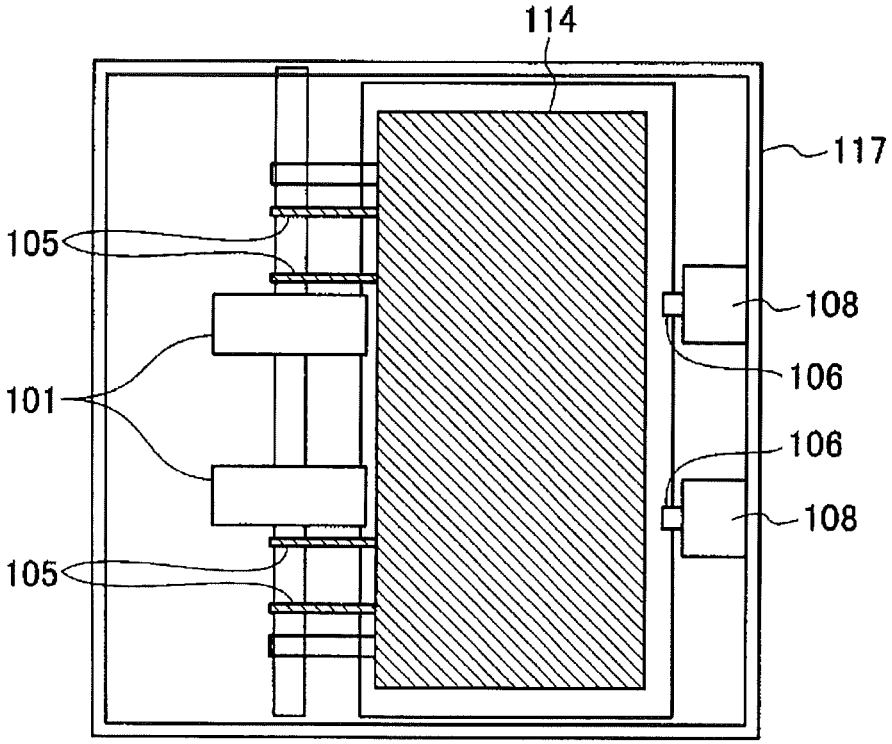
FIG. 13 is a plan view illustrating relevant portions in a configuration of a bill accumulation device of a related example.
Figure 14A:
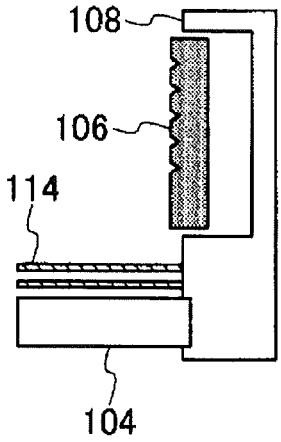
FIG. 14A is an explanatory diagram of a retraction operation of a bill stopper in a related example.
Figure 14B:
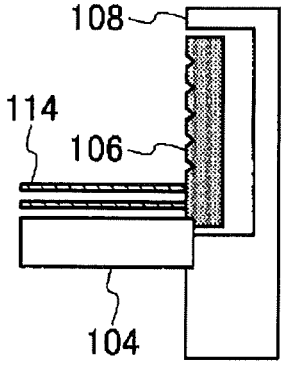
FIG. 14B is an explanatory diagram of a retraction operation of a bill stopper in a related example.
Figure 15:
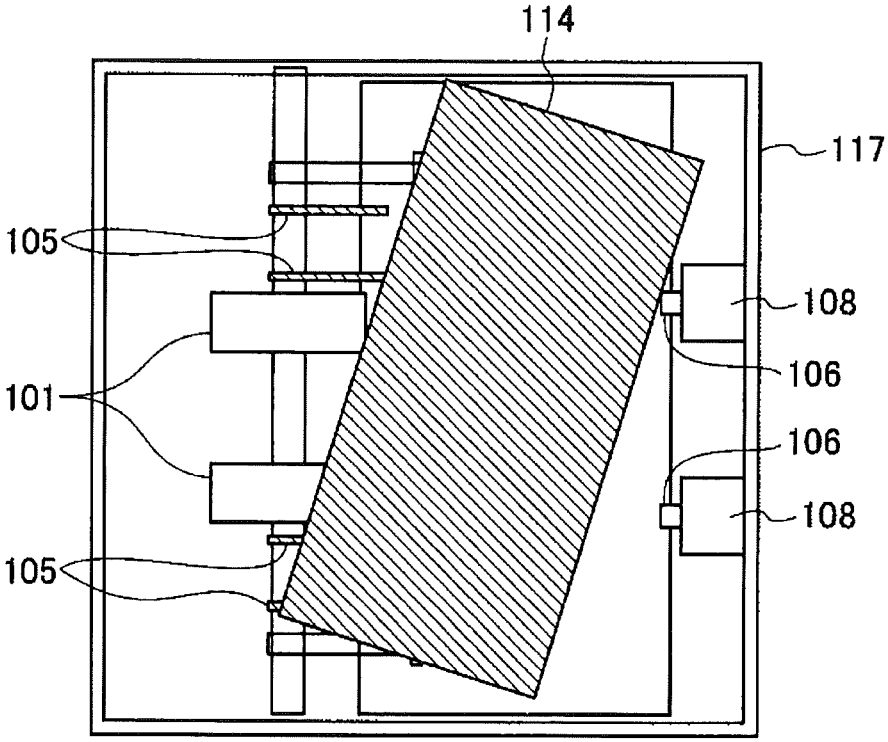
FIG. 15 is an explanatory diagram (plan view) of a banknote accumulation operation in a related example.
Figure 16:
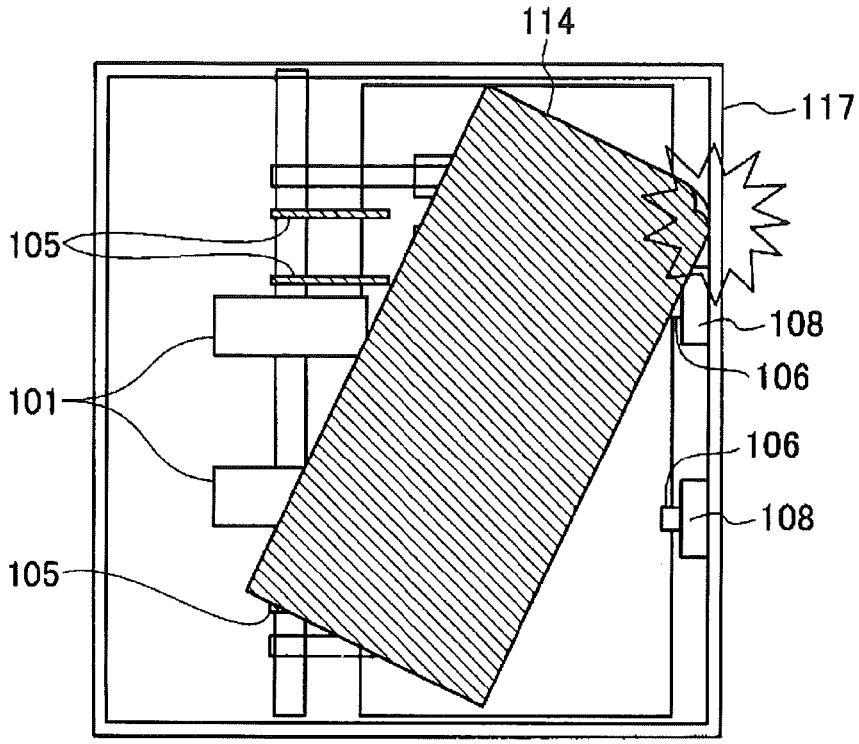
FIG. 16 is an explanatory diagram (plan view) of a banknote accumulation operation in a related example.
Figure 17:
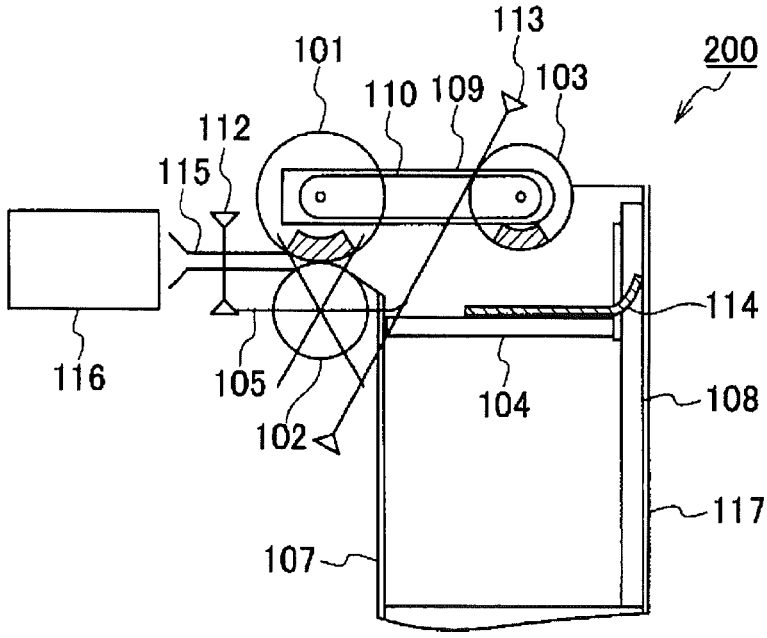
FIG. 17 is an explanatory diagram (side view) of a banknote accumulation operation in a related example.

Note that the feed roller 1, the reverse roller 2, the picker roller 3, the stage 4, the impeller 5, the bill stopper 6, the reverse guide 7, the front guides 8, the picker arm 9, the moving belt 10, the picker shaft 11, the run sensor 12, the top face sensor 13, the conveying path 15, and the external wall 17 are of similar configuration to the feed roller 101, the reverse roller 102, the picker roller 103, the stage 104, the impeller 105, the bill stopper 106, the reverse guide 107, the front guides 108, the picker arm 109, the drive belt 110, the picker shaft 111, the run sensor 112, the top face sensor 113, the conveying path 115, and the external wall 117 of FIG. 11, FIG. 12 and FIG. 13 described above, therefore further explanation thereof is omitted. An authentication section 16 is also of similar configuration to the authentication section 116 of FIG. 11 and so further explanation thereof is omitted. In the present exemplary embodiment the port for taking in and discharging banknotes configured by the feed roller 1 and the reverse roller 2 is referred to as the "gate".

18 indicates a rib, and plural ribs 18 (for example four ribs) are provided to the external wall 17 at each of the two ends on either side of the two front guides 8 disposed in the vicinity of a central portion in the length direction of banknotes for accumulation, and the ribs 18 are formed with an elongated shape in a row (disposed) so as to hold a specific separation to the length direction of the banknotes for accumulation. The length direction of each of the ribs 18 is accordingly formed so as to be orthogonal to the banknotes discharged from the gate.

V-shaped grooves are formed to each of the ribs 18 for preventing displacement in the up-down direction of the banknotes being accumulated, and plural of the V-shaped grooves that extend along the short length direction of each of the ribs 18 are formed successively along the length direction of each of the ribs 18.

In the present exemplary embodiment, explanation is given of an example in which the ribs 18 are integrally molded to the external wall 17, however configuration may be made in which the ribs 18 are attached to the external wall 17.

Figure 4:
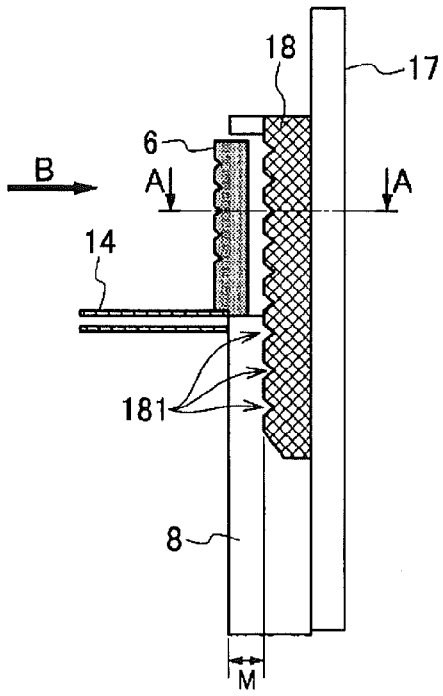
FIG. 4 is a front view of ribs of an exemplary embodiment.
Figure 5:
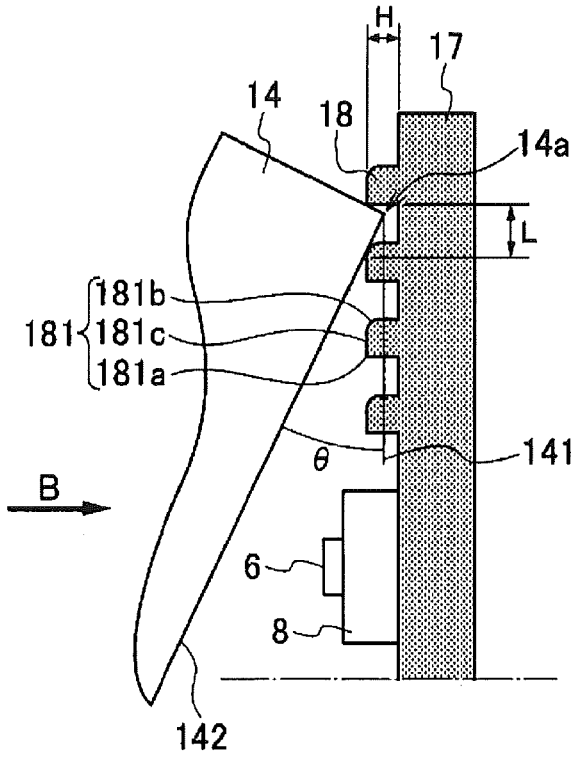
FIG. 5 is a cross-section of ribs of an exemplary embodiment.

Explanation follows regarding details of the ribs, with reference to a front view of ribs of the exemplary embodiment of FIG. 4, and a cross-section of ribs of the exemplary embodiment of FIG. 5. FIG. 5 illustrates a cross-section of rib grooves taken along line A-A of FIG. 4.

As shown in FIG. 4, the grooves 181 formed to each of the ribs 18 are profiled in a V-shape in a vertical cross-section of the ribs 18, such that when a banknote 14 has entered one of the grooves 181 it does not displace upwards or downwards. Since the grooves 181 are directed towards the up-down displacement of the banknotes 14 being accumulated, a configuration is possible in which plural projection shaped anchor members are disposed for anchoring the edge portion of banknotes 14 that have hit.

In order that non-skewed banknotes discharged from the gate do not hit the ribs 18, the ribs 18 are provided to the external wall 17 so as to retain a specific separation distance M from the banknote accumulation space configured by the front guides 8 attached to the external wall 17. Namely, the ribs 18 are formed such that the maximum depth of the ribs 18 along the banknote discharge direction, indicated by arrow B in FIG. 4, is narrower than the depth of the front guides 8 along the banknote discharge direction by the separation distance M.

On the other hand, since plural ribs 18 are disposed on the external wall 17 on each side of the two front guides 8, in respective rows along the length direction of the banknotes being accumulated (the across direction in FIG. 1), a configuration is achieved such that leading end portions of banknotes discharged from the gate with a skew hit the ribs 18.

In order to distribute force when the skewed banknotes 14 hit, as in FIG. 5, the grooves 181 of each of the ribs 18 are profiled with small radius inside curved portions 181*a* on the respective front guide 8 side (the accumulated banknote length direction central portion side), and with large radius outside curved portions 181*b* on the opposite side (the accumulated banknote length direction end portion side). Namely, the curvature of the outside curved portions 181*b* is formed less tight than the curvature of the inside curved portions 181*a*.

In order to also distribute load when a non-skewed banknote hits the rib 18 flat portions 181*c* are formed to the surface on the feed roller side of the ribs 18 between the inside curved portions 181*a* and the outside curved portions 181*b*.

In consideration of the maximum skew angle θ of banknotes being accumulated, the ribs 18 are configured such that a banknote with the maximum skew angle θ does not hit the external wall 17 prior to making contact with the ribs 18, by disposing the ribs 18 such that the relationship separation $L \leq (\tan\theta \times \text{height } H) + (\text{height } H/\tan\theta)$ is satisfied between the height H of the grooves 181 of the ribs 18 and the separation L to adjacent ribs 18.

Here, the height H of the grooves 181 of the ribs 18 is the height (depth) of the grooves 181 from the external walls 17, and is the separation distance from the external wall 17 to the end portions of the grooves 181 in the feed roller direction. Further, the separation L of the ribs 18 is the separation distance from the boundary of the flat portion 181*c* and the outside curved portions 181*b* to the wall face on the inside curved portion 181*a* side of the adjacent rib 18.

In addition, the skew angle of the banknotes is the angle formed between a line 141 orthogonal to the conveying direction of the banknotes 14 as indicated by arrow B in FIG. 5 and a line 142 connecting together the two leading ends at the left and right in the banknote length direction. The external wall 17 is formed so as to be parallel to a line orthogonal to the conveying direction of the banknotes.

The leading end portion 14*a* of the banknote 14 that has hit the ribs 18 configured as described is restricted from moving up or down by the V-shaped grooves 181, and moves in a direction away from the front guide 8 while contacting the outside curved portion 181*b*, and the leading end portion 14*a* of the banknote 14 then makes contact with both the outside curved portion 181*b* and the inside curved portion 181*a* of the adjacent groove 181. When this occurs the angle of the leading end of the banknote 14 is such that the leading end does not hit the external wall 17.

Accordingly, the end portions of banknotes discharged with a skew from the gate can be prevented from curling over.

The projection portions between adjacent grooves 181 are also profiled with inside curved portions, outside curved portions and flat portions similar to the inside curved portions 181*a*, outside curved portions 181*b* and flat portions 181*c*. The leading end portion 14*a* of the banknote 14 that has hit one of the projection portions of the ribs 18 accordingly moves in the direction away from the front guide 8 while making contact with the outside curved portion of the projection portion, such that the leading end portion 14*a* of the banknote 14 then makes contact with both the outside curved portion and the inside curved portion of the adjacent 18.

As shown in FIG. 1, the lower portions of the ribs 18 are disposed during stacking such that there is an overlap to below the top face of the stage 4 or below the top face of the banknotes that stacked on the stage 4. The upper portion of the ribs 18 is also disposed such that there is an overlap to a top face guide, not shown in the drawings, that determines the banknote accumulation space, and also disposed at a height such that the leading end of a banknote 14 that has been fed in with a skew makes contact with the ribs 18 before hitting the external wall 17.

The ribs 18 are disposed and formed with grooves of a height such that the specific separation distance M is maintained from the end portion of the front guide 8 on the side of the banknotes 14 stacked on the stage 4 to the apex portion of the ribs 18, as shown in FIG. 4. Accordingly, configuration is made such that skewed banknotes 14 that have been discharged from the gate hit the ribs 18 before making contact with the external wall 17, and are stacked on the stage 4, then, due to the impeller 5 rotating, the banknotes stacked on the stage 4 are pulled towards the gate side, the banknotes are caused to hit the reverse guide 7 in order to make the left and right sides even in the banknote length direction, and the skew-corrected stacked banknotes are then not in contact with the ribs 18.

Explanation follows regarding operation of the configuration described above.

FIG. 6 to FIG. 10 are explanatory diagrams illustrating operation of a bill accumulation device of an exemplary embodiment, and explanation follows regarding accumulation operation for banknotes that have been fed out with a skew (at an angle), with reference to FIG. 6 to FIG. 10.

Figure 6:
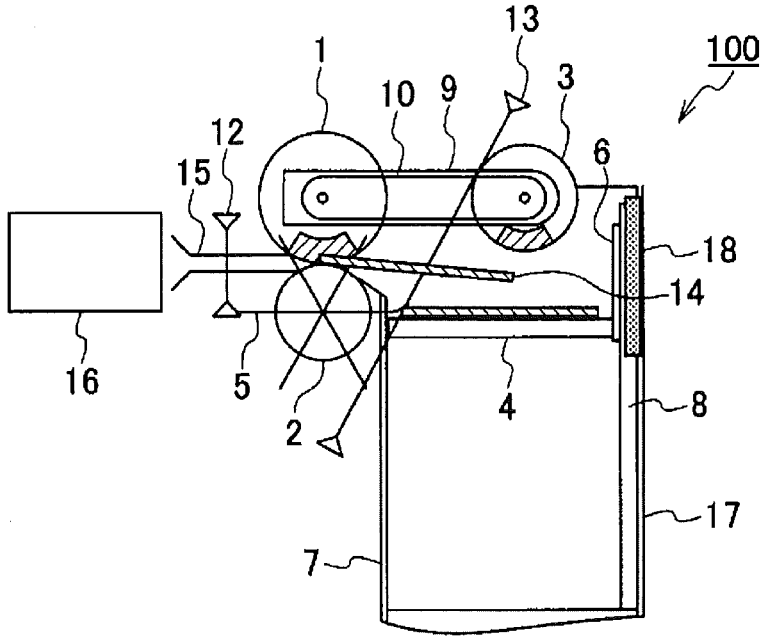
FIG. 6 is an explanatory diagram of operation of a bill accumulation device of an exemplary embodiment.

Explanation first follows regarding a banknote discharge operation, with reference to FIG. 6.

As shown in FIG. 6, the banknotes 14 that arrive from the conveying path 15 pass through the authentication section 16 and are inspected for skew angle by the authentication section 16, and if the skew angle is determined to be larger than a specific skew angle then banknotes are carried to a dedicated stacking store for accumulation, not shown in the drawings, however, if the skew angle is determined to be the specific angle or less the banknotes are discharged from the gate of the bill accumulation device 100 into the banknote accumulation space.

Figure 7:
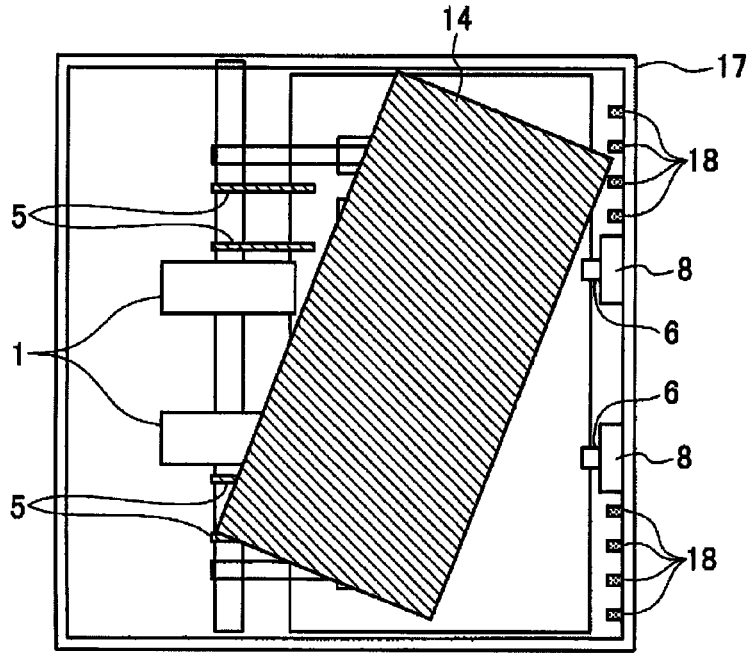
FIG. 7 is an explanatory diagram of operation of a bill accumulation device of an exemplary embodiment.

Explanation follows regarding an operation in which a discharged banknote impacts the ribs, with reference to FIG. 7.

As shown in FIG. 7, the discharged banknote 14 is further fed out and impacts the V-grooved ribs 18 prior to impacting the bill stopper 6. Note that, at this time, the corner at the leading end of the banknote 14 does not hit the external wall 17.

Due to the end face of the banknote 14 entering into a groove (recess portion) of the V-grooved ribs 18, the banknote 14 does not move in the up-down direction. The banknote is bowed overall due to the banknote 14 being fed out further by the feed roller 1 that is nipping the rear edge of the banknote 14.

Figure 8:
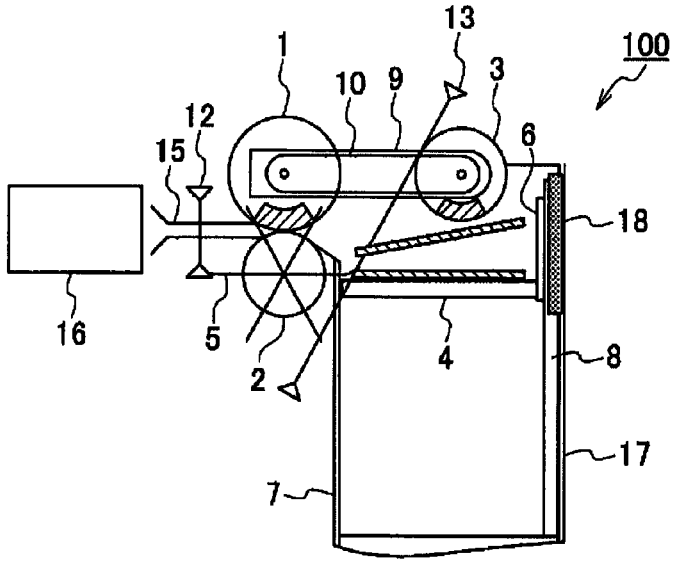
FIG. 8 is an explanatory diagram of operation of a bill accumulation device of an exemplary embodiment.

Explanation follows regarding an operation in which the rear edge of the banknote that has impacted the ribs is tapped by the impeller, with reference to FIG. 8.

As shown in FIG. 8, the banknote 14 that has impacted the V-grooved ribs 18 is then further fed out, and bowing of the banknote 14 is released when the rear edge of the banknote 14 exits from the gate, so as to adopt a flat shape. The rear edge of the banknote 14 is tapped by the rotating impeller 5 and pressed onto the stage 4.

Figure 9:
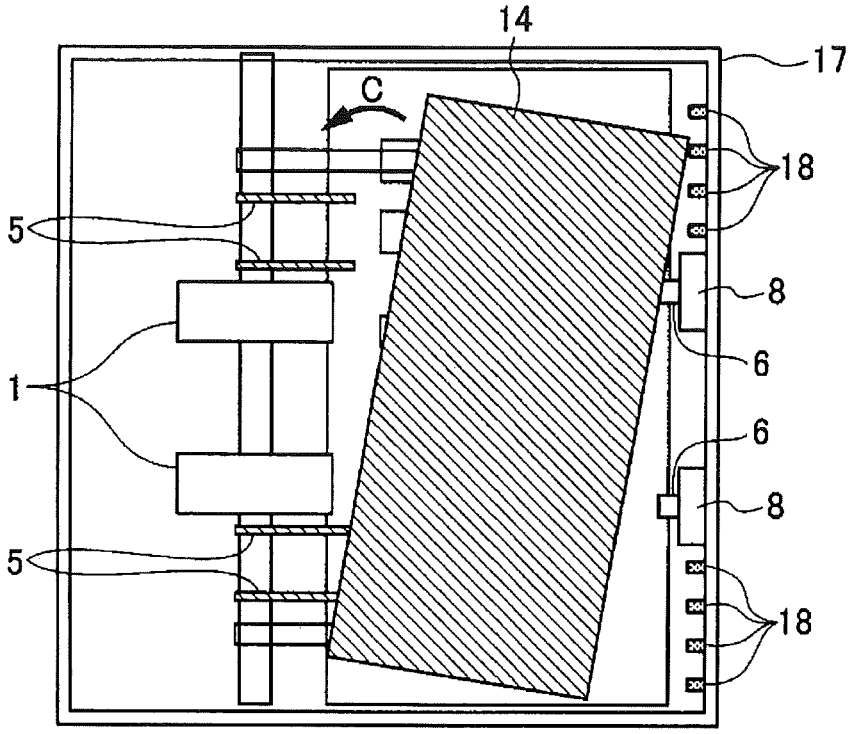
FIG. 9 is an explanatory diagram of operation of a bill accumulation device of an exemplary embodiment.

Explanation follows regarding an operation in which the banknote is drawn in by the impeller, with reference to FIG. 9.

As shown in FIG. 9, since the banknote 14 that has been pressed onto the stage 4 intrudes into the rotation path of the impeller 5, the banknote 14 is drawn towards the reverse guide 7 side indicated by arrow C in FIG. 9 by friction force against the rotating impeller 5.

Further, the banknote 14 is drawn in to the reverse guide 7 at the left and right in the banknote length direction, and the end face of the banknote 14 is pressed against the reverse guide 7, correcting any skew such that the banknote 14 is then disposed completely separated from the V-grooved ribs 18.

Figure 10:
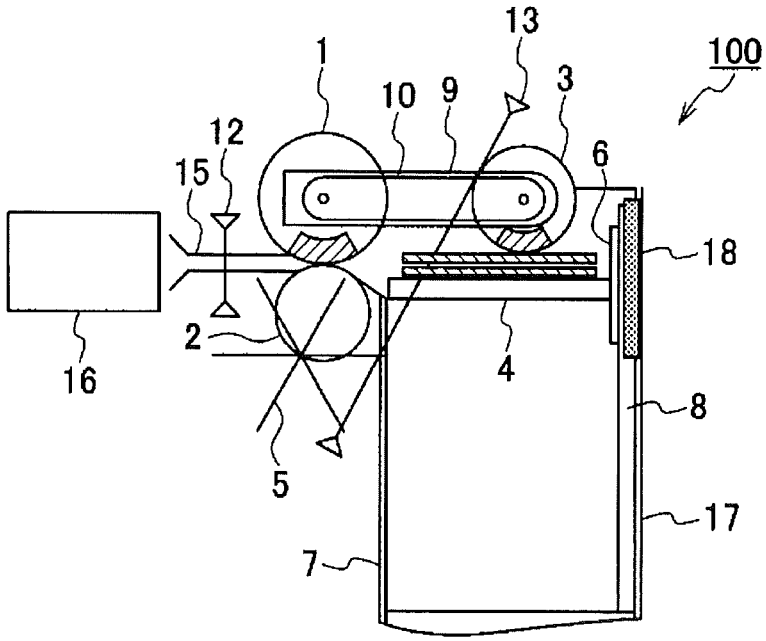
FIG. 10 is an explanatory diagram of operation of a bill accumulation device of an exemplary embodiment.

Explanation follows regarding a moving operation from a stacked state to a separated state, with reference to FIG. 10.

As shown in FIG. 10, rotation of the feed roller 1 and the reverse roller 2 is stopped when the banknotes 14 have been conveyed from the conveying path 15 and stacking of the banknotes 14 on the stage 4 has been completed. The impeller 5 is then retracted to a position that does not make contact with the banknotes 14 and the stage 4 is raised to a position at which the banknotes 14 stacked on the stage 4 make contact with the picker roller 3. Due to the banknotes 14 on the stage 4 not being in contact with the V-grooved ribs 18 they can be moved in the stacked state without becoming misaligned, and separation operation is performed smoothly.

As explained above, in the present exemplary embodiment, the plural ribs provided to the external wall so as to face the gate (the banknote discharge port) are disposed such that the relationship separation $L \leq (\tan\theta \times \text{height } H) + (\text{height } H/\tan\theta)$ is satisfied between the maximum skew angle θ of the banknotes being accumulated, the height H of the ribs, and the separation L to adjacent ribs. Due to such a configuration, the invention of the present exemplary embodiment can prevent a banknote with the maximum skew angle θ from hitting the external wall, thereby enabling the depth of the accumulation space in the banknote conveying direction (the short length direction of the stacked banknotes) to be shorted without banknote stacking problems arising, an advantageous effect is accordingly exhibited of enabling a device to be made more compact.

Accordingly, an advantageous effect is obtained of enabling an automated teller machine, equipped with plural of the bill accumulation devices in order to handle multiple denominations, to be installed in a small facility area.

Although explanation has been given in the present exemplary embodiment of a case in which V-grooved ribs are fixed to the external wall, application is possible to a bill stopper that is rendered moveable by a spring, for example.

Explanation has been given in the present exemplary embodiment of a case in which grooves are formed with a V-shape to the ribs, however configuration may be made in which projections are formed on the ribs capable of restricting the end faces of the banknotes from moving upwards or downwards.

The invention claimed is:

1. A bill accumulation device, comprising:

a guide member for stopping bills discharged by a conveying means;

a stage, upon which the bills stopped by the guide member are stacked; and a plurality of elongated shaped ribs each extending in a rib long length direction, and each having a plurality of grooves that extend along a rib short length direction, the ribs, in the rib long length direction, being respectively disposed orthogonal to the bills being discharged, with plural ones of the ribs being disposed in a row at specific intervals from each other on both sides of the guide member, wherein:

each of the ribs has curved portions, and a bill-receiving face of each of the ribs is positioned at a downstream side from a bill-receiving face of the guide member in a bill discharge direction.

2. The bill accumulation device of claim 1, wherein:

the guide member includes a front guide and a bill stopper, each of the ribs being formed to an external wall to which the front guide is attached, such that the maximum depth of the ribs in the bill discharge direction is shorter than a depth of the front guide in the bill discharge direction, and the bill-receiving face of each of the ribs is positioned at a downstream side from a bill-receiving face of the bill stopper in the bill discharge direction.

3. The bill accumulation device of claim 2, wherein:

the grooves on each of the ribs are profiled with an inside curved portion on a front guide side of the groove and an outside curved portion at an opposite side of the groove to the inside curved portion; and a curvature of the outside curved portion is more gentle than a curvature of the inside curved portion.

4. The bill accumulation device of claim 3, wherein:

the grooves on each of the ribs are further profiled with a flat portion between the inside curved portion and the outside curved portion; and each of the ribs is disposed to satisfy a relation of $L \leq (\tan\theta \times \text{height } H) + (\text{height } H/\tan\theta)$, wherein L is a separation from a side face of a first of the ribs on an inside curved portion side to a boundary between the outside curved portion and the flat portion of the rib adjacent to the first rib, H is a height at the groove of the rib from the external wall, and θ is a maximum skew angle θ of the bills being discharged.

5. The bill accumulation device of claim 1, wherein:

the grooves on each of the ribs are profiled with the curved portions including an inside curved portion on a guide member side of the groove and an outside curved portion at an opposite side of the groove to the inside curved portion; and a curvature of the outside curved portion is more gentle than a curvature of the inside curved portion.

6. The bill accumulation device of claim 5, wherein:

the grooves on each of the ribs are further profiled with a flat portion between the inside curved portion and the outside curved portion; and each of the ribs is disposed to satisfy a relation of $L \leq (\tan\theta \times \text{height } H) + (\text{height } H/\tan\theta)$, wherein L is a separation from a side face of a first of the ribs on an inside curved portion side to a boundary between the outside curved portion and the flat portion of the rib adjacent to the first rib, H is a height at the groove of the rib from an external wall, and θ is a maximum skew angle θ of the bills being discharged.

7. The bill accumulation device of claim 1, further comprising an external wall to which the ribs are formed, wherein a height of each of the ribs and the specific intervals between the ribs are set such that leading end portions of the bills with a skew do not hit the external wall.

8. The bill accumulation device of claim 1, wherein the guide member includes a front guide and a bill stopper, each of the ribs being formed to an external wall to which the front guide is attached, such that the maximum depth of the ribs in the bill discharge direction is shorter than a depth of the front guide in the bill discharge direction.

9. A bill accumulation device, comprising:

a guide member that stops bills discharged by a conveying means;

a stage, upon which the bills stopped by the guide member are stacked; and a plurality of elongated shaped ribs respectively disposed on each of outer sides of the guide member, wherein each of the ribs includes a plurality of grooves, with curved portions being formed inside the grooves.

10. The bill accumulation device of claim 9, wherein each of the plurality of ribs is provided at position deeper than the guide member in a bill discharge direction.

11. The bill accumulation device of claim 9, wherein the ribs are disposed in a row and at specific intervals from each other.

12. The bill accumulation device of claim 9, wherein each of the ribs is disposed on an external wall.

13. The bill accumulation device of claim 9, wherein the grooves are V-shaped in cross-section.

14. The bill accumulation device of claim 13, wherein the curved potion comprises an inside curved portion at a side nearer to the guide member and an outside curved portion at an opposite side.

15. The bill accumulation device of claim 9, further comprising an external wall to which the ribs are formed, wherein a height of each of the ribs and intervals between the ribs are set such that leading end portions of the bills with a skew do not hit the external wall.

16. A bill accumulation device, comprising:

a front guide;

a reverse guide;

an accumulation space for bills;

a bill stopper provided on the front guide for receiving and stopping bills discharged by a conveying means;

a stage, upon which the bills that have been received and stopped by the bill stopper, are stacked; and a plurality of elongated shaped ribs each extending in a rib long length direction, and each having a plurality of V-shaped grooves that extend along a rib short length direction, the ribs, in the rib long length direction, being respectively disposed orthogonal to the bills being discharged, the ribs being disposed in a row at specific intervals from each other on both sides of the front guide, the grooves on each of the ribs being profiled with an outside curved portion at a side opposite of a front guide side of the groove.

17. The bill accumulation device of claim 16, wherein each of the ribs is configured such that a maximum depth of the ribs in the bill discharge direction is shorter than a depth of the front guide in the bill discharge direction.

18. The bill accumulation device of claim 16, wherein the grooves on each of the ribs are profiled with an inside curved portion on the front guide side of the groove; and a curvature of the outside curved portion is more gentle than a curvature of the inside curved portion.

* * * * *